US005325773A

United States Patent [19]

Manduley

[11] Patent Number: 5,325,773

[45] Date of Patent: Jul. 5, 1994

[54] MULTI-VALUE DISPENSING APPARATUS

[75] Inventor: Flavio M. Manduley, Woodbury, Conn.

[73] Assignee: Pitney Bowes Inc., Stamford, Conn.

[21] Appl. No.: 997,048

[22] Filed: Dec. 28, 1992

[51] Int. Cl.[5] ..... B41L 47/46

[52] U.S. Cl. ..... 101/91; 101/78; 101/287

[58] Field of Search ..... 101/91, 78, 287, 333, 101/334

[56] References Cited

U.S. PATENT DOCUMENTS

| | | | |
|---|---|---|---|
| 710,997 | 10/1902 | Pitney . | |
| 2,491,214 | 12/1949 | Rouan et al. . | |
| 3,682,378 | 8/1972 | Rouan et al. | 101/91 |
| 3,869,986 | 3/1975 | Hubbard | 101/91 |
| 4,579,054 | 4/1986 | Buan et al. . | |
| 5,009,137 | 4/1991 | Dannatt | 101/91 |
| 5,060,741 | 10/1991 | Abellana et al. | 101/91 |

*Primary Examiner*—Edgar S. Burr
*Assistant Examiner*—John S. Hilten
*Attorney, Agent, or Firm*—Peter Vrahotes; Melvin J. Scolnick

[57] ABSTRACT

The invention is concerned with a low cost postage value generating apparatus wherein the number of postage imprints are determined rather than an accounting of the postage value. The apparatus has two movable print heads each having a single value font. This device is able to print multi-values by using multiple impressions of the two print heads. Because of this, the number of imprints gives a representation of the total postage value dispensed.

11 Claims, 3 Drawing Sheets

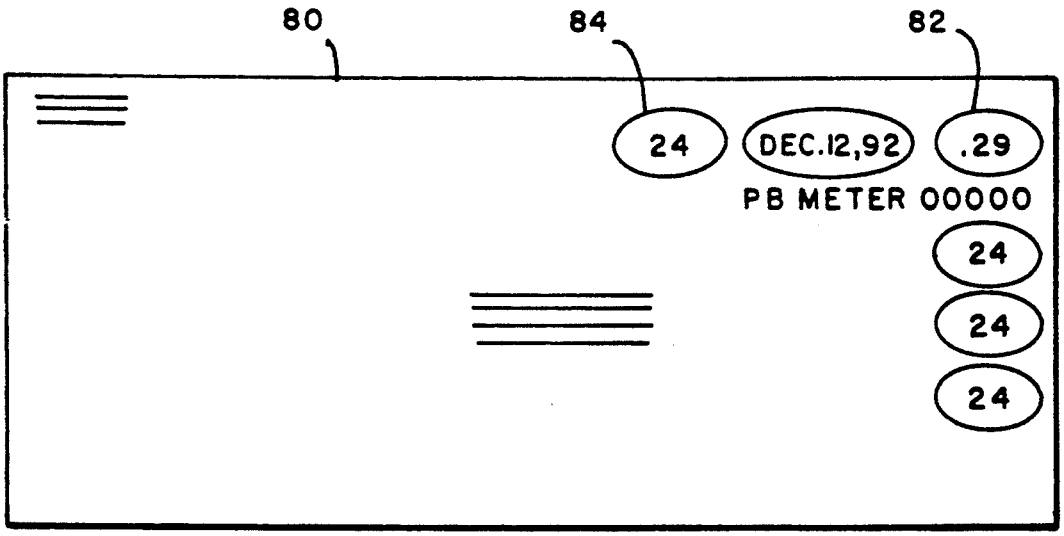
FIG. 4
FIG. 5
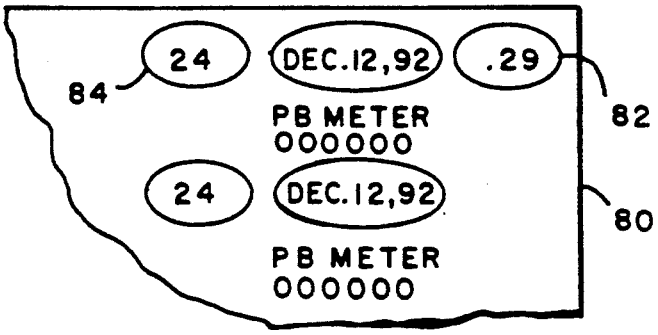
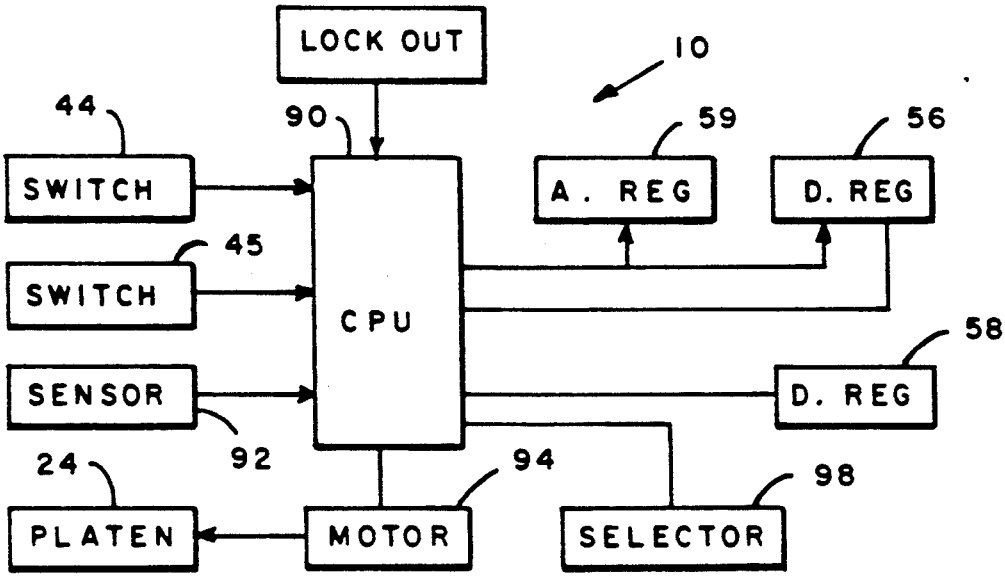
FIG. 6

MULTI-VALUE DISPENSING APPARATUS

FIELD OF THE INVENTION

The instant invention resides in the field of value dispensing. There are many ways in which value can be applied to an item as for example by imprinted postage indicia, food stamps, theatre tickets, tax stamps and the like. The instant invention will be described as it can be practiced in the field of postage indicia applying. At least with regard to business mail, throughout the years, the most common form of postage has been the postage indicia wherein a device, such as a postage meter, is used to print a postage indicia upon the item to be mailed or upon a tape that is attached to the item to be mailed. This invention describes an apparatus for dispensing postage.

DESCRIPTION OF RELATED ART

By far the most well known device for dispensing postage is the postage meter. Heretofore, postage meters have not been used generally in a home or home office environment because of the cost associated with owning or leasing such a device. It will be appreciated that in the United States postage meters can only be leased from their manufacturer, but in most other countries postage meters can be purchased. These postage dispensing devices are expensive because of the requirement of precise accounting, and the need of security associated with such devices. A postage meter has an ascending register which records the value of postage that has been dispensed and a descending register that records the amount of postage remaining from the amount purchased from the post office. Because the postage meter contains the equivalent of monetary value, security measures must be taken to assure that only the purchased amount of postage can be applied. Additionally the meter user must be able to dispense the amount of postage that has been purchased. Although these devices have worked well in the past, heretofore no successful commercial postage dispensing device has been provided whereby postage can be dispensed securely at a low cost. In particular, no one yet has provided a low cost postage dispensing apparatus which can be discarded after the postage value purchased by the user has been consumed.

Another feature of prior postage dispensing devices is that values of different amounts could be printed by setting the print head of the device as required. Because of the requirement that variable amounts of postage be printed, this has added to the complexity of the postage dispensing devices. There is a need for a low cost, secure postage metering device that is capable of printing postage indicia upon letter mail regardless of the weight of the mail. Despite this fact, no low cost postage dispensing apparatus has been provided commercially whereby an individual can send first class mail of different weights from a home office, because of the present costs of postage dispensing devices.

SUMMARY OF THE INVENTION

A value dispensing apparatus has been conceived wherein the apparatus is capable of printing different values of postage on letter mail, as for example, first class mail, having a weight of one through four ounces. The device of the instant invention records the number of postage imprints for each cost increment rather than having an accounting of the postage value printed. This is possible since the dispensing apparatus is only capable of printing one of two postage values, either 19¢ or 24¢. Because the apparatus is able to print only one of two values, the number of imprints for each value gives a representation of the total postage value that has been dispensed based upon how often each value is printed on a mailpiece.

After the total postage value purchased from the postal service has been dispensed, the postage value dispensing apparatus is rendered inoperable in any one of a number of convenient ways.

Because only one of two postage values is printed and there is no direct accounting of the postage dispensed, a relatively simple and inexpensive apparatus can be achieved.

BRIEF DESCRIPTION OF THE DRAWING

FIG. 4 is a plan view of a mail piece on which indicia have been printed using one embodiment of the instant invention;

FIG. 5 is a plan view of a portion of a mail piece on which indicia have been printed in another embodiment of the invention, and FIG. 6, is a functional block diagram of an electronic embodiment of the instant invention.

DETAILED DESCRIPTION OF THE PREFERRED EMBODIMENT

Figure 1:
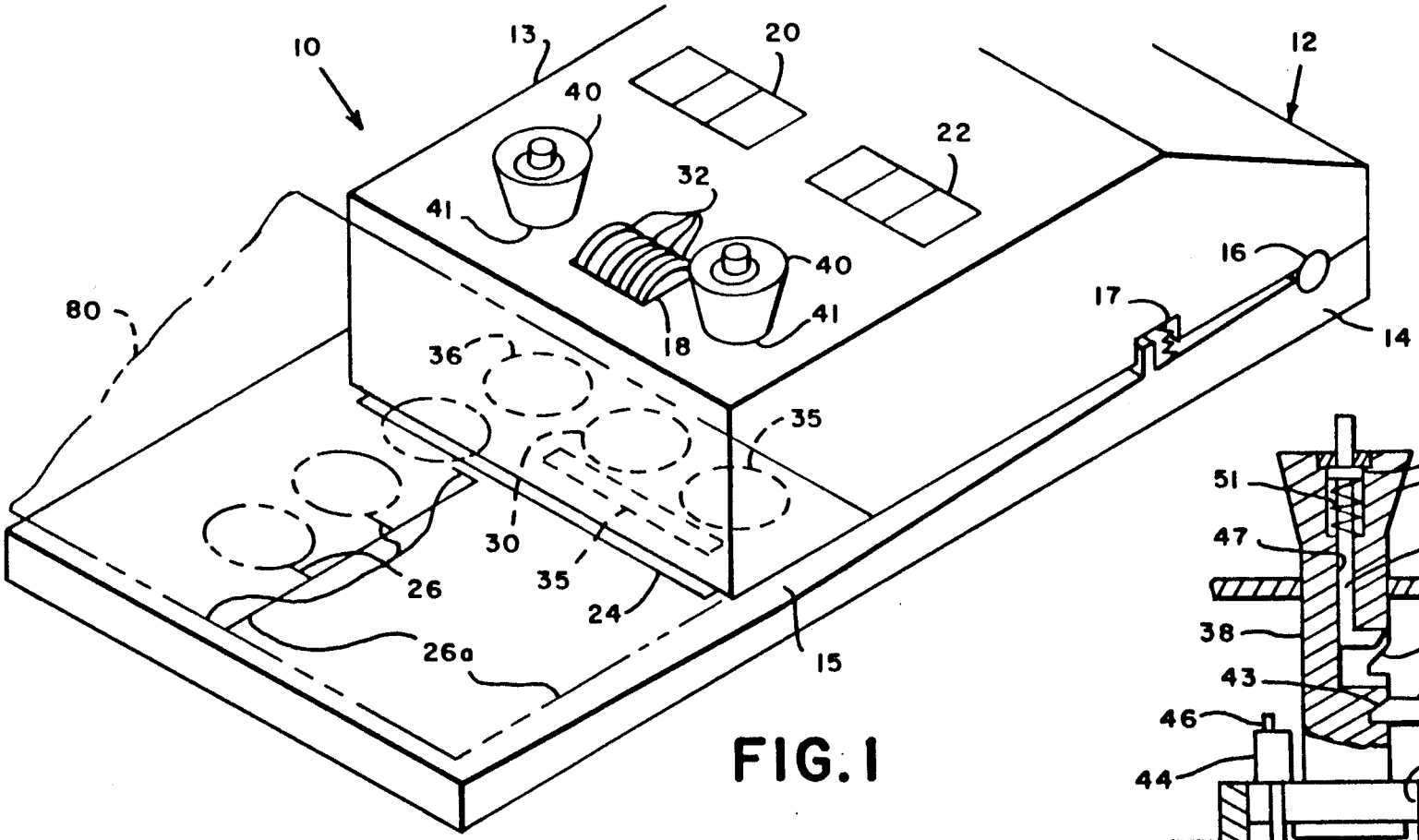
FIG. 1 is a perspective view of the exterior of a postage value dispensing apparatus in which the instant invention can be utilized.
Figure 2:
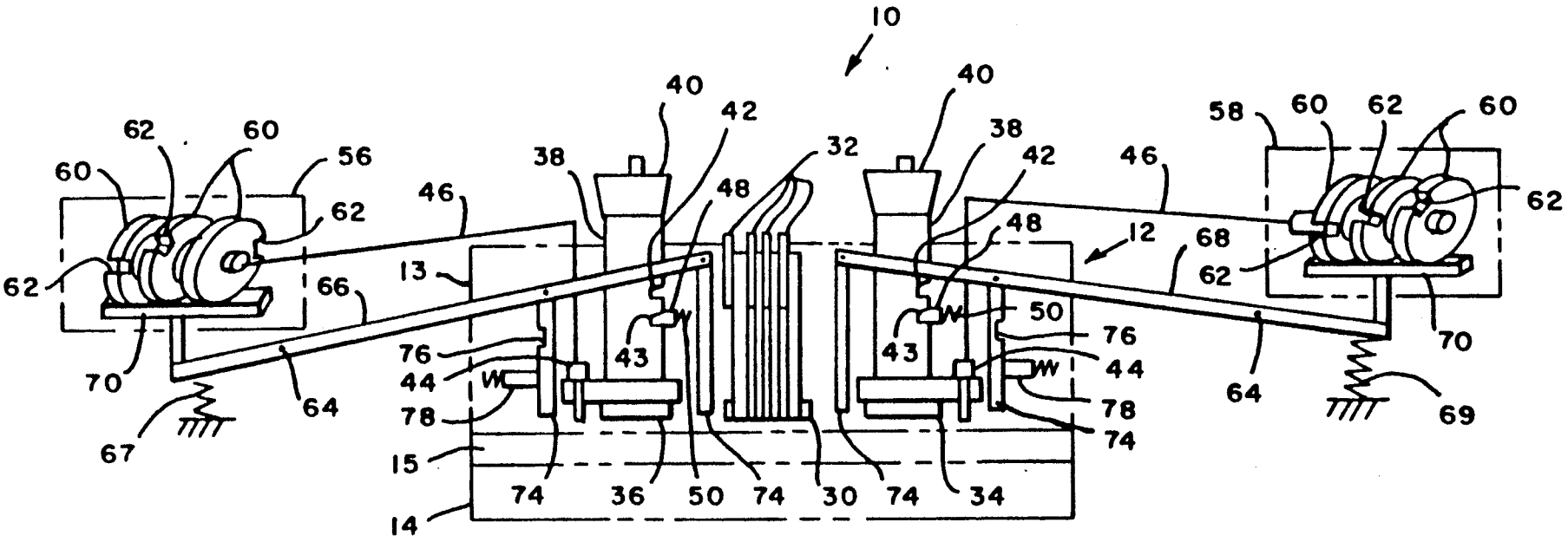
FIG. 2 is a partially cross-sectional view and a partially schematic representation of a mechanical embodiment of the invention.

With reference to FIG. 1, a postage value dispensing device is shown at 10 that utilizes the instant invention. The apparatus 10 is provided with a housing 12 that has an upper portion 13 and a lower portion 14 that are pivotally connected by a pivot shaft 16. The housing 12 can be a secured housing as is well known in the art. See, for example, U.S. Pat. No. 4,579,054 for a type of secure housing that can be used in the instant invention. A pair of springs 17 (only one being shown) are connected to the two portions 13, 14 to urged them apart. The two portions 13, 14 of the housing 12 define a housing slot 15 that is adapted to receive an envelope. The upper portion 13 has an opening 18 and a pair of windows 20, 22. The housing 12 has platen 24 that is located on the lower portion 14 at the location of the slot 15. Located on the lower portion 14, in the vicinity of the slot 15 are a plurality of alignment marks 26, **26*a*. These alignment marks 16 are provided to properly align an envelope as will become evident hereinafter. Supported within the housing 12 are a pair of postage printheads 34, 36 each of which is movable into and out of the slot 15, as will be described hereinafter, and made of a material such as inked foam rubber. A dater printer 30 is also received within the housing 12 and has thumb wheels 32 received within the opening 18 by which the date bands on the date printer can be changed. Such date stamps are well known in the art, and will not be described in any great detail. Suffice it to say the date stamper will have a month band, two day bands and a year band with appropriate thumb wheels 32 for adjusting the date bands. Each postage printhead 34, 36 will have a single value thereon, as for example the value of 29¢ for a first class one ounce letter for one of the printhead 34 and 24¢ on the other printhead 36 to be used for a two ounce letter. An additional 24¢ impression can be made for each ounce above two ounces, as shown in FIGS. 4 and 5. Although single value print heads are shown in FIGS. 1 and 2, it will be appreciated that a multi-font printing devices can be used so that the amount of postage to be printed can be adjusted. Such adjustment would be undertaken either by the post office or by the value dispensing apparatus 10 manufacturer and not by the user of the apparatus. Only the fonts representing the value to be printed would be exposed in the slot 15 and the other fonts would be enclosed by the housing 12**. Self ink printing devices of this type are commercially available, such as an Echo pre-inked stamper model Custom D-2 available from Schwerdtle Stamp Co., Bridgeport, Conn.

The printing of a serial number is provided by a set of fixed fonts 35 located on the upper portion 13 and extending into the slot 15 for purpose of security. As is known, mail with postage for a value dispensing device is assigned to a particular post office where it must be deposited. By having mail from each such device channelled through such a single post office, opportunity for misuse of such a device is reduced. The fonts 35 will have an indicator of the apparatus 10 manufacturer as well as the serial number as seen in FIGS. 4 and 5.

Figure 3:
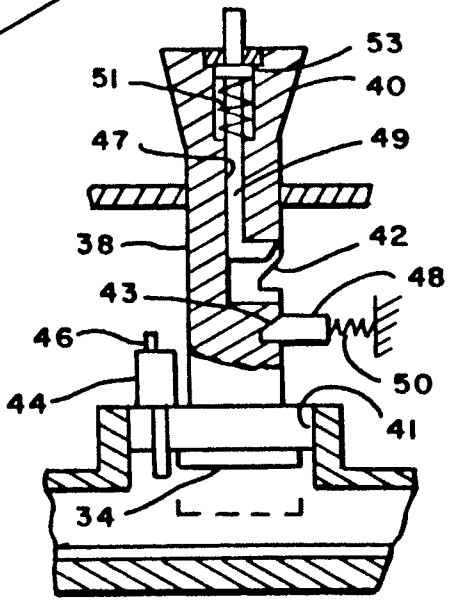
FIG. 3 is a cross sectional view of a print head mechanism used in the apparatus of FIGS. 1 and 2.

With reference now to FIG. 3, details of the postage print heads 34, 36 will be described. It will be appreciated that the construction of both print heads 34, 36 will be the same with the exception of the value represented by the fonts. The print heads 34, 36 are attached to a stem 38 that extends through an opening 41 of the housing 12 at the location of the slot 15. A handle 40 is attached to the end of the stem 38 that extends outside the housing 12. The stem 38 has a pair of recess 42, 43 on one side thereof into which a latch 48 is receivable, the latch being urged toward the stem by a spring 50 supported by the housing 12. The stem has a central opening 47 that receives a movable member 49 that includes the recess 42. A spring 51 urges the member upwardly by engaging a collar 53 attached to the movable member 49. This combination forms a detent whereby the print head 34 will be in a first, or lower, position with the latch 48 receiving in the recess 42 and will be in a second, or upper, position when the latch 48 is received within the recess 43. By depressing the exposed portion to the movable member 49, the spring 51 is overcome thereby pushing the latch 48 out of the locking position so that the stem 38 can be lifted. Each printhead 34, 36 head also has an activator 44 that will be located, along with its respective print head, within the slot 15 when the print head is in the lower position. Each activator 44 has a connection 46 which connects a respective activator to a descending register 56, 58. The descending registers 56, 58 are aligned with the windows 20, 22 so that the units on the registers can be read. Each descending register has a plurality of accounting wheels 60 each of which has a slot 62 therein. The connections 46 between the actuators 44, 45 can be either mechanical connections or electrical or is well known in the art and will not be described in detail. Reference can be had to U.S. Pat. No. 4,579,054 for description of decrementing a register. Although the invention is described showing only a descending register, it will be appreciated that an ascending register can also be included if desired.

With reference to FIG. 2, the slots 62 of the accounting wheels 60 of a descending registers 56, 58 will be in alignment with one another when a descending register has used all its value and a zero value amount appears in a window 20, 22. A pair of pivots 64 are located in the housing 12 and each has pivot arm 66, 68 pivotally mounted therein. Springs 67, 69 are supported by the housing 12 and urge the pivot arms 66, 68, in a counter clockwise direction, relatively relative to the pivots 46. The end of each pivot arm 66, 68 adjacent the descending registers 56, 58 has a slide 70 thereon that is directed against the accounting wheels 60 and adapted to be received within the slots 62 of the accounting wheels 60 when the accounting wheels register a zero value. It will be appreciated that a slide 70 must engage all slots 62 of a descending register 56, 58 simultaneously before the spring 67,69 will pivot a pivot arm to move slide 70 into the slots 62. On the opposite end of each pivot arm 66, 68 are a pair of fingers 74 that will be moved into the slot 15 upon its respective pivot arms 66, 68 rotating about the pivot 64 when one of the descending registers reaches a zero value. Each finger 74 has a recess 76 therein that is adapted to receive a spring loaded latch 78 when the fingers have been moved into the slot 15 to prevent further printing. In this way, no further imprint can be obtained from a print head for which all its value has been consumed. It will be appreciated that the apparatus 10 is not disabled when either of the descending registers has not been reduced to a zero value, but it is within the contemplation of the invention to disable both print heads 34, 36 upon either descending register 56, 58 attaining a zero value.

With reference now to FIG. 6, a value postage dispensing apparatus 10 is shown in electronic form wherein like reference numbers are used for like parts. The housing supports a central processing unit (CPU) 90 that communicates with the activators 44, 45 and a sensor 92 that are located within the slot 15. The CPU 90 is also in communication with the descending registers 56, 58 and the embodiment also includes an ascending register 59. A motor 94 is in communication with the CPU 60 and the platen 24 whereby upon the sensor 92 sensing the presence of an envelope in the slot 15 the motor 94 will be actuated to drive the platen 18 toward the printheads 34, 36. A selector 98 is in communication with the CPU 90 whereby either or both of the printheads 34, 36 can be selected for printing. Upon the platen 18 being driven into engagement with either or both of the printheads 34, 36, depending upon their being selected or not, the CPU 90 will cause either or both of the descending registers 58 to decrement the value therein by one unit. When either of the descending registers 56, 58 reaches a zero value, the CPU 90 will disable at least a portion of the electronic mechanism of the meter 10 so that no further printing can take place with at least one of the print heads. The CPU 90 can be in communication with the fingers 54 to cause them to drop down into the slot 15, or it could release a liquid substance so that the self inking printhead 20 would be unable to print any further. The electronic embodiment could include both ascending and descending registers and have full electronic capability, in which case a display & keyboard could be included to provide communication therewith.

An important feature of the invention is that the descending registers 56, 58 only decrement one unit at a time, each unit representing a printing event. One unit of the descending register 56 represents value for first class one ounce mail presently 29¢. Thus the descending register 56 could be adjusted to allow 200 imprints and the user would be required to pay $580.00 for the printing of two hundred 29¢ impressions. The second descending register 58 will increment one unit every time the print head 36 prints an indicia of 24¢ on a mailpiece that has a weight greater than one ounce. Because only numbered events are recorded, a rather low cost accounting device can be provided. Also, since there are only two values being printed, there is no need for adjustment of accounting wheels 60 for different values and there is no need for providing correlation between print wheel and the descending register to properly record the amount of postage being printed. It will be appreciated that only descending registers have been shown in FIG. 1 as that is only what is required for this apparatus, but an ascending register 59 also can be provided if desired as shown in FIG. 5.

In operation, with reference to FIGS. 1 and 4, when one indicia is to be printed on a mailpiece 80, only the 29¢ print head 34 will be placed in the printing position for a mailpiece that weighs one ounce or less. The other print head 36 will be in the upper position with the latch 48 received within the recess 43. The mailpiece 80 will be aligned with its leading, or right edge, in alignment with the first, or right, longitudinal alignment mark 26*a* and the first lateral alignment mark 26. In this way only a 29¢ indicia 82, and the serial number and date, will be printed on the upper right hand corner of the face of the mailpiece 80. When the mailpiece 80 weighs between one the two ounces, the second print head 36 will be depressed into the printing position so that the latch 48 engages the recess 42 so that a 24¢ indicia 84 can be printed. The envelope 80 will be in the same position relative to the alignment marks as described previously only this time two indicia will be printed, 29¢ and 24¢ to indicate 53¢ has been paid in postage. Needless to say, when these two indicias 82, 84 are printed, both descending registers will be decremented one unit. In the situation where a mail piece weighs between 2 and 3 ounces, the 29¢ and 24¢ indicia will be printed as described previously and thereafter the envelope 80 will be moved inwardly to the alignment mark 26 and to the left and aligned with the second, or left, alignment mark 26*a*. The 29¢ print head will be lifted out of the printing position with the latch 48 engaging the recess 43 and only the 0.24¢ indicia 84 will be printed and will appear below the 29¢ indicia as seen in FIG. 4. With such printing the descending register 58 will be decremented one unit. If the mailpiece were to weigh between three and four ounces an addition 24¢ indicia will be printed by moving the envelope further into the slot and in alignment with the third alignment mark 26. Upon printing the fourth indicia, $1.01 worth will have been printed and an accounting made thereof. Provision is made for printing a left indicia, as seen in FIG. 4, by again re-aligning the envelope 80.

FIG. 5 shows an embodiment should the post office require the meter number and date be printed upon each dispensing of value. In this embodiment, the date stamp 30 and the meter number fonts 35 would be re-arranged is as to print in a manner shown in FIG. 5. More specifically, the 24¢ print head 36 would always print an indicia to the left of the 29¢ indicia and the envelope would be inserted further into the slot 15 to produce additional 24¢ imprints.

Thus what has been shown and described is a low cost "throw away" postage value dispensing device that is able to print and account for multiple single value postage.

The above embodiments have been given by way of illustration only, and other embodiments of the instant invention will be apparent to those skilled in the art from consideration of the detailed description. Accordingly, limitations on the instant invention are to be found only in the claims.

What is claimed is:

1. A value dispensing apparatus comprising:

a housing, a plurality of printheads each having a single fixed value font supported in said housing, a pair of counters supported within said housing, a platen, said printheads spaced from and movable relative to said platen for contact therewith, a plurality of activators, each activator being supported by one of said printheads, each of said activators having means for communicating with one of said counters for incrementing each of said counters one unit so as to count the number of contacts between each one of said printhead and said platen, and disabling means in communication with said counters and said printheads for rendering a printhead in a non-printable state upon its respective counter attaining a zero value.

2. The apparatus of claim 1 wherein said disabling means comprises a pair of arm members, each of said arm members being in engagement with one of said counters and said printheads, and means for lockingly engaging one of said arm members with a print head in non-printable position upon one of said counters reaching a zero value.

3. The apparatus of claim 1 further including a sensor located within said slot in a position for sensing the presence of a mail piece and a motor in communication with said platen and said sensor for driving said platen into contact with said printheads upon said mail piece being sensed by said sensor.

4. The apparatus of claim 1 wherein said plurality of print heads are movably supported within said housing and further including means for moving each of said printhead into contacting position with said platen.

5. The apparatus of claim 1 wherein each of said counters comprises a plurality of accounting wheels, each of said accounting wheels having a slot therein and said arm members are pivotally supported by said housing and have latches that contact said accounting wheels and means for driving each of said latches into a respective one of said slots upon said accounting wheel slots becoming aligned with one said latches.

6. A value dispensing apparatus comprising:

a housing having an upper portion and a lower portion movable relative to one another and forming a housing slot therebetween, a pair of printheads movably supported by said upper portion of said housing and having a single fixed value font receivable within said housing slot, a pair of counters supported with said housing one of said counters in communication with one of said printheads, a platen, said printheads spaced from and movable relative to said platen for contact with said value fonts, and a pair of activators, each activator being supported by one of said printheads, each of said activators having means for communication with one of said counters for incrementing a counter one unit upon its respective printhead contacting said platen, and disabling means in communicating with said counters and said printheads for rendering a printhead in a non-printable state upon its respective counter attaining a zero value.

7. The apparatus of claim 6 wherein said disabling means comprises a pair of arms each of said arms being in engagement with one of said counters at one end and having a finger at its other end receivable within said housing slot whereby upon said counter reaching a zero value, said arm is actuated to drive a finger into said housing slot.

8. The apparatus of claim 6 further including a sensor located within said slot in a position for sensing the presence of a mail piece and a motor in communication with said platen and said sensor for driving said platen into contact with said printheads upon said mail piece being sensed by said sensor.

9. The apparatus of claim 6 further including said pair of print heads each having a pair of recesses therein and a detent supported by said housing and receivable within said pair of openings.

10. The apparatus of claim 9 wherein said lower portion of said housing has alignment marks in the vicinity of said housing slot for aligning a mailpiece within said slot.

11. The apparatus of claim 6 wherein said upper and lower portions are pivotally connected to one another and further including an extention spring for urging said upper and lower portions away from one another.

* * * * *